US005643046A

United States Patent [19]

Katakabe et al.

[11] Patent Number: 5,643,046

[45] Date of Patent: Jul. 1, 1997

[54] POLISHING METHOD AND APPARATUS FOR DETECTING A POLISHING END POINT OF A SEMICONDUCTOR WAFER

[75] Inventors: Ichiro Katakabe; Naoto Miyashita, both of Kanagawa-ken; Tatsuo Akiyama, Tokyo, all of Japan

[73] Assignee: Kabushiki Kaisha Toshiba, Kawasaki, Japan

[21] Appl. No.: 390,529

[22] Filed: Feb. 17, 1995

[30] Foreign Application Priority Data

Feb. 21, 1994 [JP] Japan ..... 6-022486
Jan. 14, 1995 [JP] Japan ..... 7-021075

[51] Int. Cl.[6] ..... B24B 49/04; B24B 49/12; B24B 7/22

[52] U.S. Cl. ..... 451/6; 451/288

[58] Field of Search ..... 451/41, 5, 6, 8, 451/287, 288, 289, 290

[56] References Cited

U.S. PATENT DOCUMENTS 4,272,924 6/1981 Masuko et al. ..... 451/41
5,069,002 12/1991 Sandhu et al. ..... 451/41
5,081,796 1/1992 Schultz ..... 451/41
5,308,438 5/1994 Cote et al. ..... 451/41
5,433,650 7/1995 Winebarger ..... 451/287

*Primary Examiner*—Robert A. Rose
*Attorney, Agent, or Firm*—Michael N. Meller

[57] ABSTRACT

A polishing method and apparatus are provided for detecting the polishing end point of a semi-conductor wafer having a polishing film and a stopper film formed thereon. First driving means are provided having a first drive shaft for rotating a polishing plate and a polishing cloth thereon. Second driving means having a second rotatable drive shaft are also provided. Mounting means for mounting the semi-conductor wafer is adapted to be rotated by the second driving means for polishing the wafer. Energy supplying means for supplying prescribed energy to the semi-conductor wafer are also included. Finally, detecting means for detecting a polishing end point of the polishing film is included and detects a variation of the energy supplied to the semi-conductor wafer. Different types of energy can be utilized such as infrared light and a vibration wave.

9 Claims, 12 Drawing Sheets

POLISHING METHOD AND APPARATUS FOR DETECTING A POLISHING END POINT OF A SEMICONDUCTOR WAFER

BACKGROUND OF THE INVENTION

1. Field of the Invention

The present invention relates to a polishing method and apparatus for detecting a polishing end point of a film formed on a semiconductor wafer, such as a poly-Si film, an interlayer insulation film, or a metal film.

2. Description of the Related Art

Conventionally, etchback RIE (reactive ion etching) is known as a method for flattening the surface of a structure in which an arbitrary material is buried in grooves such as contact holes [see FIGS. 1(*a*)–1(*e*)]. This method will be described below with reference to FIGS. 1(*a*)–1 (*e*).

First, a $SiO_2$ film 102 is formed on a Si substrate 101, and a poly-Si film 103, to become a stopper film, is formed thereon by chemical-vapor deposition (CVD) [FIG. 1(*a*)]. Then, the poly-Si film 103 and the Si substrate 101 are selectively removed by RIE, to thereby form grooves [FIG. 1(*b*)]. A $SiO_2$ film 105 is deposited by CVD in the grooves 104 and on the surface of the poly-Si film 103 [FIG. 1(*c*)].

In this case, the surface of the $SiO_2$ film 105 is formed with depressions at locations corresponding to the grooves 104. To reduce the roughness, an etchback resist 106 is formed on the $SiO_2$ film 105 [FIG. 1(*d*)]. Then, RIE is performed under the condition that the etchback resist 106 and the $SiO_2$ film 105 are etched at approximately the same rate [FIG. 1(*e*)]. This etchback RIE step produces a structure in which the $SiO_2$ film 105 is buffed only in the grooves 104 and the surface of the poly-Si film 103, i.e., the wafer surface is flattened. The flattening of the wafer surface is realized by setting the etching rate of the poly-Si film 103 (stopper film) lower than that of the $SiO_2$ film 105.

When the surface of the poly-Si film 103 starts to be exposed after the $SiO_2$ film 105 is etched out, a peak corresponding to Si of the poly-Si film 103 appears in the spectrum of plasma discharge light. By detecting the peak corresponding to the poly-Si film 103 by monitoring a variation of the discharge spectrum, the end point of etching the $SiO_2$ film 105 by etchback RIE can be detected. Thus, the burying of the $SiO_2$ film 105 in the grooves 104 is completed.

In the above RIE, the stopper film plays an important role in detecting the etching end point of the film being etched. The stopper film should be of a kind that is most suitable for the process and apparatus used and the conditions.

However, the etchback RIE method has the following disadvantages. It consists of many steps including coating of an etchback resist. RIE damage is likely to occur in a wafer surface. It is difficult to provide a wafer surface superior in flatness. A vacuum-type apparatus is used that is complex in structure. Further, a dangerous etching gas is used.

In view of the above problems of the etchback RIE method, recently the CMP (chemical mechanical polishing) method has been investigated widely.

FIG. 2 shows a general structure of a polishing apparatus for CMP, which will be described below.

A polishing plate support 205 is mounted on a stage 201 via a bearing 203. A polishing plate 207 is placed on the polishing plate support 205. A polishing cloth 209 is attached to the polishing plate 207. To rotate the polishing plate support 205 and the polishing plate 207, a drive shaft 211 is connected to central portions of those members. The drive shaft 211 is rotated by a motor 213 via a rotary belt 215.

A wafer 217 is suctioned, by vacuum or stretching, by a suction plate 223 on which a template 219 and a suction cloth 221 are provided so as to be opposite to the polishing cloth 209. The suction plate 223 is connected to a drive shaft 225, which is rotated by a motor 227 via gears 229 and 231. The drive shaft 225 is fixed to a driving stage 233 with respect to vertical movement. With this structure, the driving stage 233 is moved vertically with vertical movement of a cylinder 235 and, as a result, the wafer that is fixed to the suction plate 223 is pressed against the polishing cloth 209 or removed therefrom.

The apparatus has a separate driving system (not shown) to move the wafer in the X/Y directions during a polishing operation. A polishing agent suitable for an intended polishing operation is introduced into the space between the wafer 217 and the polishing cloth 209, to thereby effect the polishing operation.

Referring to FIGS. 3(*a*)–3(*d*), an example of the CMP method using the polishing apparatus of FIG. 2 will be described below. First, a $Si_3N_4$ film 302 is formed on a Si substrate 301 [FIG. 3(*a*)]. Then, prescribed portions of the $Si_3N_4$ film 302 and the Si substrate 301 are etched (patterning) [FIG. 3(*b*)]. A $SiO_2$ film 304 is deposited in grooves 303 and on the surface of the $Si_3N_4$ film 302 [FIG. 3(*c*)]. Then, the $SiO_2$ film 304 is polished by CMP. When the exposure of the $Si_3N_4$ film 302 (stopper film) is detected, the polishing of the $SiO_2$ film 304 is finished. Thus, the burying of the $SiO_2$ film 304 in the grooves 303 is completed [FIG. 3(*d*)].

Compared to the etchback method of FIGS. 1(*a*)–1(*e*), the CMP method has the advantages of a reduced number of steps and superior flatness.

The CMP method itself is not a new technique, but has been used in a process of making semiconductor wafers from an ingot. In recent years, the CMP technique came to be used in manufacturing processes of highly integrated devices.

Referring to FIGS. 4(*a*) and 4(*b*) and FIGS. 5(*a*)–5(*e*), examples of application of the CMP method to highly integrated devices will be described below.

FIGS. 4(*a*) and 4(*b*) show an example of application of the CMP method to a trench device separating process.

First, after a $SiO_2$ film 403 is formed by thermally oxidizing the surface portion of the Si substrate 401, a $Si_3N_4$ film 405 that is to serve as a polishing stopper film is formed by CVD. Then, the $Si_3N_4$ film 405, $SiO_2$ film 403 and Si substrate 401 are removed partially, i.e., in device separating regions (patterning by lithography), to thereby form grooves 407. Then, the surface portions of the Si substrate 401 within the grooves 407 are oxidized, and boron ions are implanted into the bottom portions of the grooves 407 to form channel-cut regions 409. A poly-Si (or $SiO_2$) film 411 is deposited in the grooves 407 by CVD [FIG. 4(*a*)].

Thereafter, the poly-Si film 411 on the wafer surface is polished to expose the $Si_3N_4$ film 405 [FIG. 4(*b*)]. Since the polishing conditions are so set that the polishing rate of the $Si_3N_4$ film 405 is as low as about 1/200 to 1/10 of that of the poly-Si film 411, the polishing can be stopped by the $Si_3N_4$ film 405. Thus, the poly-Si film 411 can be buried only in the grooves 407.

In this manner, by employing, as the stopper film, a film that has a polishing rate lower than that of a film to be polished and specifying a polishing time, the polishing can be finished when the stopper film is exposed.

FIGS. 5(*a*)–5(*e*) show an example of application of the CMP method to burying metal wiring lines in grooves of an insulating film.

First, a CVD-$SiO_2$ film 503 and a plasma-$SiO_2$ 505 are successively formed on a Si substrate 501 [FIG. 5(*a*)]. Grooves 507 are formed by patterning in the plasma-$SiO_2$ film 505 at prescribed positions [FIG. 5(*b*)]. A Cu film 509 is deposited in the grooves 507 and on the entire surface of the plasma-$SiO_2$ film 505 [FIG. 5(*c*)]. Then, the Cu film 509 is polished using the plasma-$SiO_2$ film 505 as a stopper film. The polishing of the Cu film 509 is finished when the plasma-$SiO_2$ film 505 is exposed. Thus, the Cu film 509 is buried only in the grooves 507, to form Cu wiring lines [FIG. 5(*d*)].

The wafer surface is flattened by the polishing, to thereby facilitate subsequent formation of a second plasma-$SiO_2$ film 511 [FIG. 5(*e*)]. Further, the flattening by CMP facilitates formation of wiring lines of the second and third layers (not shown).

However, an effective method for detecting a polishing end point has not been established in the above types of CMP methods for highly integrated devices. Conventionally, the end point detection is performed by properly setting the polishing time. Since various kinds of films are laid on a wafer surface (or a Si substrate surface) as shown in FIGS. 3(*a*)–5(*e*), the polishing should be finished with high accuracy when a stopper layer under a film being polished is exposed.

However, the thickness of films to be polished varies over a wide range of several tens of nanometers to several microns, and the thickness also varies even among wafers of the same type. Therefore, the detection of the polishing end point simply by setting the polishing time has the problem that overpolishing may occur. In such case, a stopper film may be entirely removed and even a film under the stopper film is polished. Conversely, an insufficient polishing time may permit a polishing film, that is laid on a stopper film, to remain.

Thus, it is very important to develop a technique for detecting a polishing end point.

In one of the conventional polishing end point detecting methods, the end point is detected based on a variation of wafer capacitance which variation is caused by the decreasing thickness of the film being polished.

However, this method has the following problems. First, variation of the capacitance is small during the polishing process. Second, the wafer capacitance varies depending on the product and the manufacturing process, because films formed on a wafer may have a multilayered structure and the chip pattern varies with the type of product. Therefore, the end point detecting conditions need to be carefully adjusted for each case.

Among other problems, the wafer capacitance cannot be detected on a real-time basis during a polishing operation. Accordingly, the capacitance-based end point detecting method is not widely employed.

As the device structure is miniaturized, the quantity of the removed material by polishing is reduced, which means a smaller difference between the wafer capacitance at the start of polishing and that at its end. Therefore, it is difficult to detect positively such a small variation with high accuracy.

SUMMARY OF THE INVENTION

Therefore, a first object of the present invention is to provide a wafer polishing apparatus comprising energy-generating means for supplying first energy to a wafer, and means for detecting a polishing end point by detecting second energy that is output from the wafer in response to the first energy.

A second object of the present invention is to provide a method for detecting a polishing end point of a wafer comprising the steps of:

polishing the wafer;

supplying first energy from energy generating means to the wafer;

detecting second energy that is output from the wafer in response to the first energy; and detecting a signal indicating the polishing end point from the second energy.

DETAILED DESCRIPTION OF THE PREFERRED EMBODIMENTS

Figure 1A:
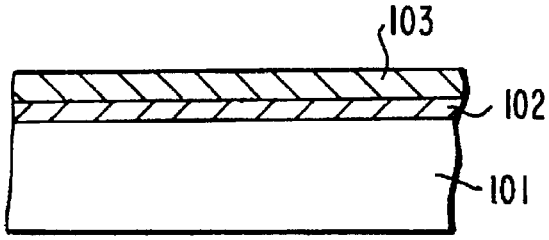
FIG. 1a PRIOR ART
FIGS. 1(*a*)–1(*e*) show a process for flattening layered films by etchback RIE.
Figure 1B:
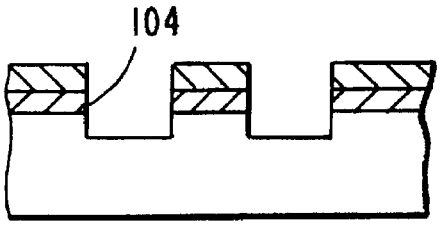
FIG. 1b PRIOR ART
Figure 1C:
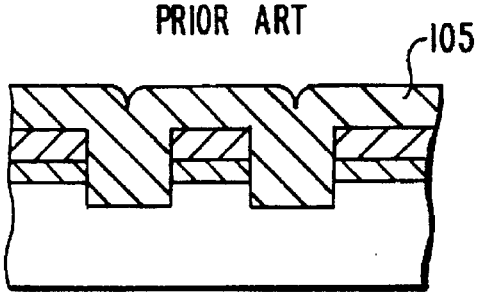
FIG. 1c PRIOR ART
Figure 1D:
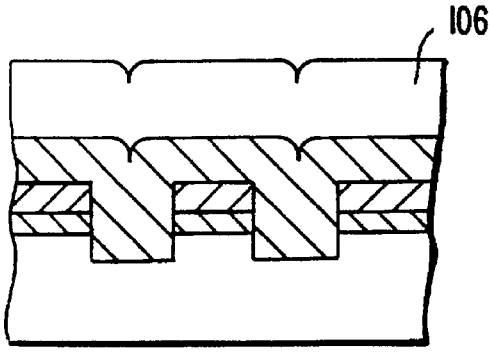
FIG. 1d PRIOR ART
Figure 1E:
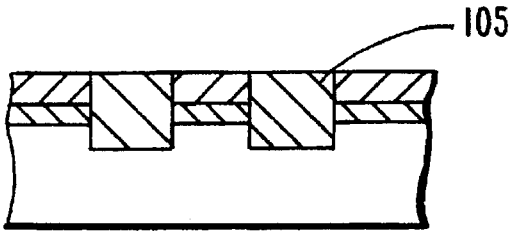
FIG. 1e PRIOR ART
Figure 2:
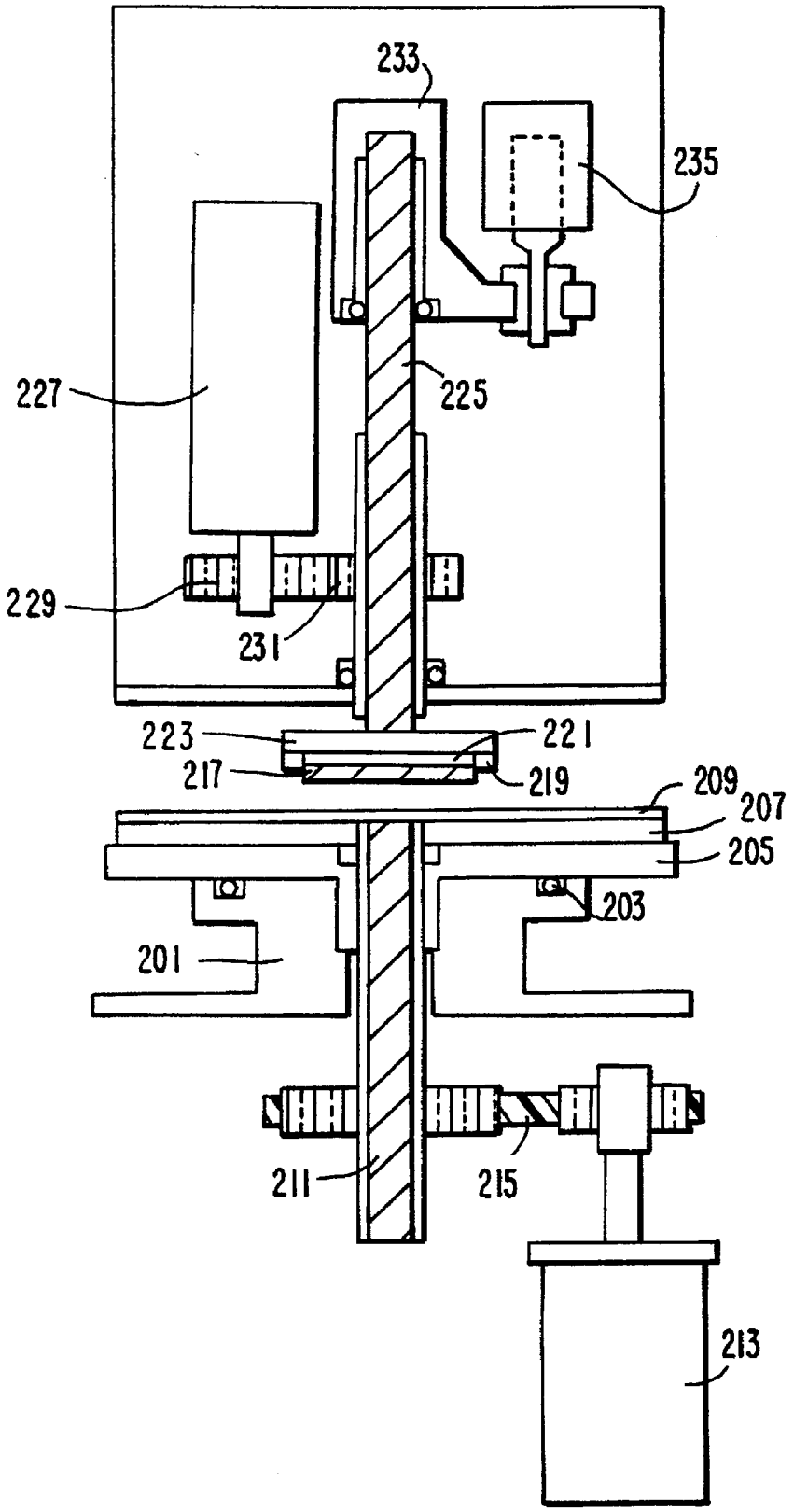
FIG. 2 PRIOR ART
FIG. 2 is a front view of the general structure of a conventional polishing apparatus.
Figure 3A:
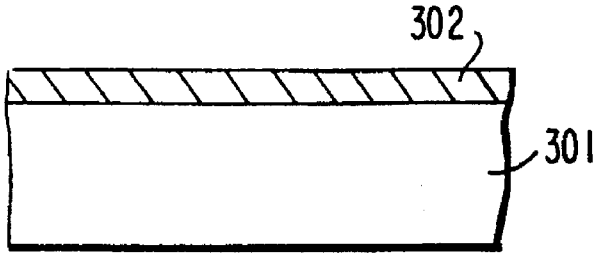
FIG. 3a PRIOR ART
FIGS. 3(*a*)–3(*d*) show a process for flattening a $SiO_2$ film by the CMP method.
Figure 3B:
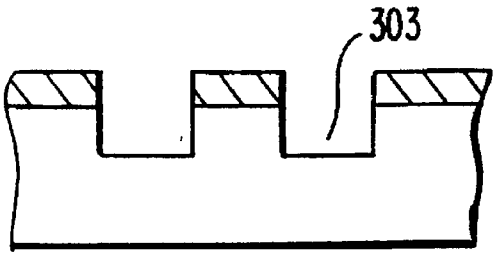
FIG. 3b PRIOR ART
Figure 3C:
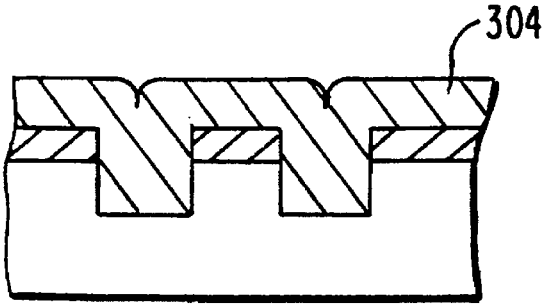
FIG. 3c PRIOR ART
Figure 3D:
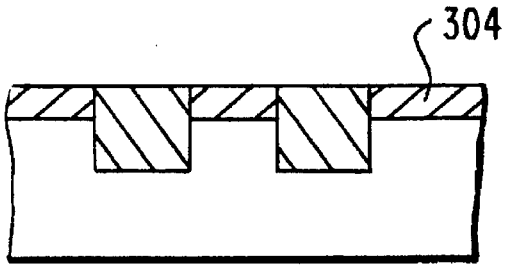
FIG. 3d PRIOR ART
Figure 4A:
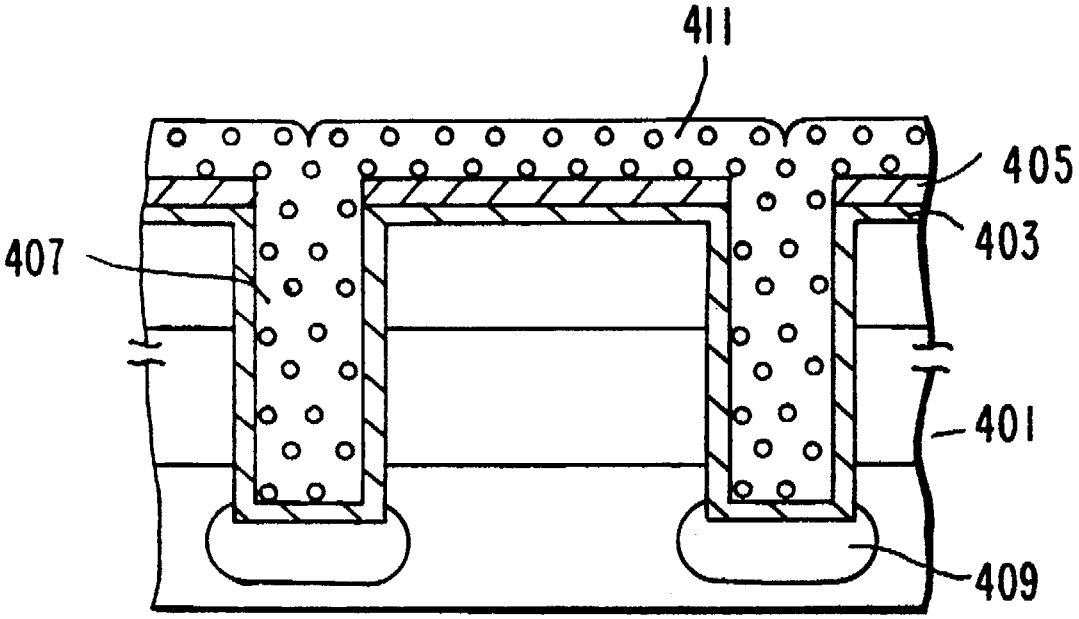
FIG. 4a PRIOR ART
FIGS. 4(*a*) and 4(*b*) show an example of application of the CMP method to a trench device separating process.
Figure 4B:
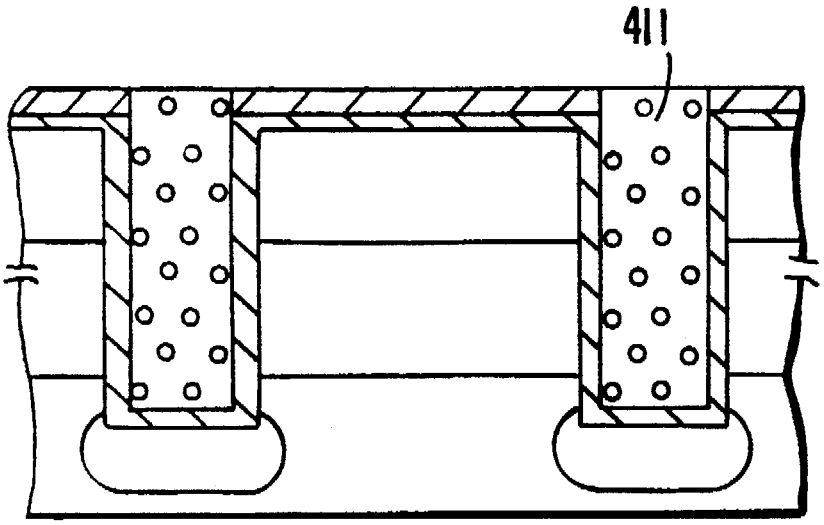
FIG. 4b PRIOR ART
Figure 5A:
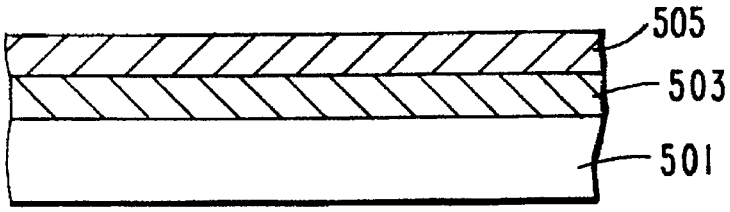
FIG. 5a PRIOR ART
FIGS.5 (*a*)–5(*e*) show an example of application of the CMP method to a metal wiring burying process.
Figure 5B:
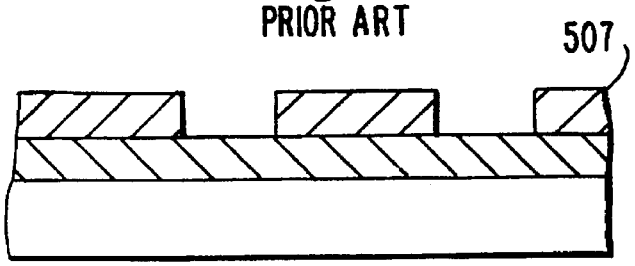
FIG. 5b PRIOR ART
Figure 5C:
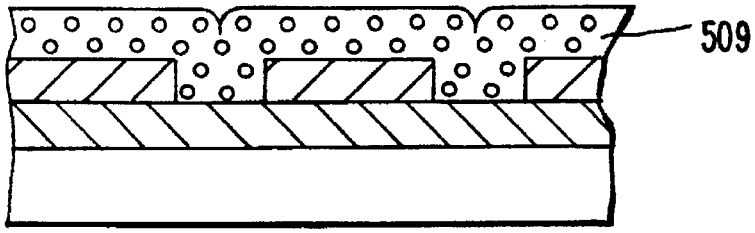
FIG. 5c PRIOR ART
Figure 5D:
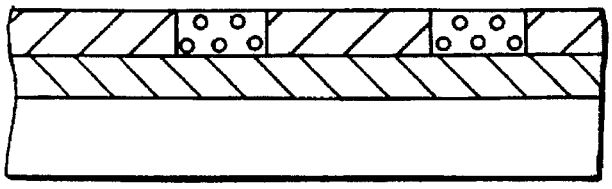
FIG. 5d PRIOR ART
Figure 5E:
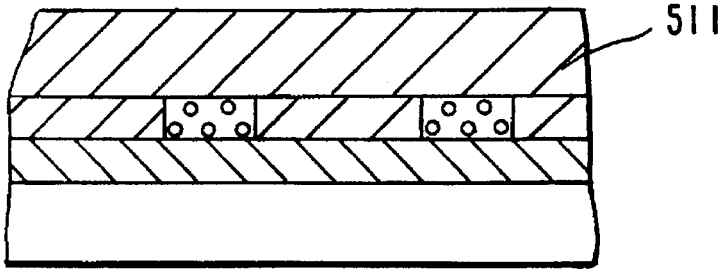
FIG. 5e PRIOR ART
Figure 6:
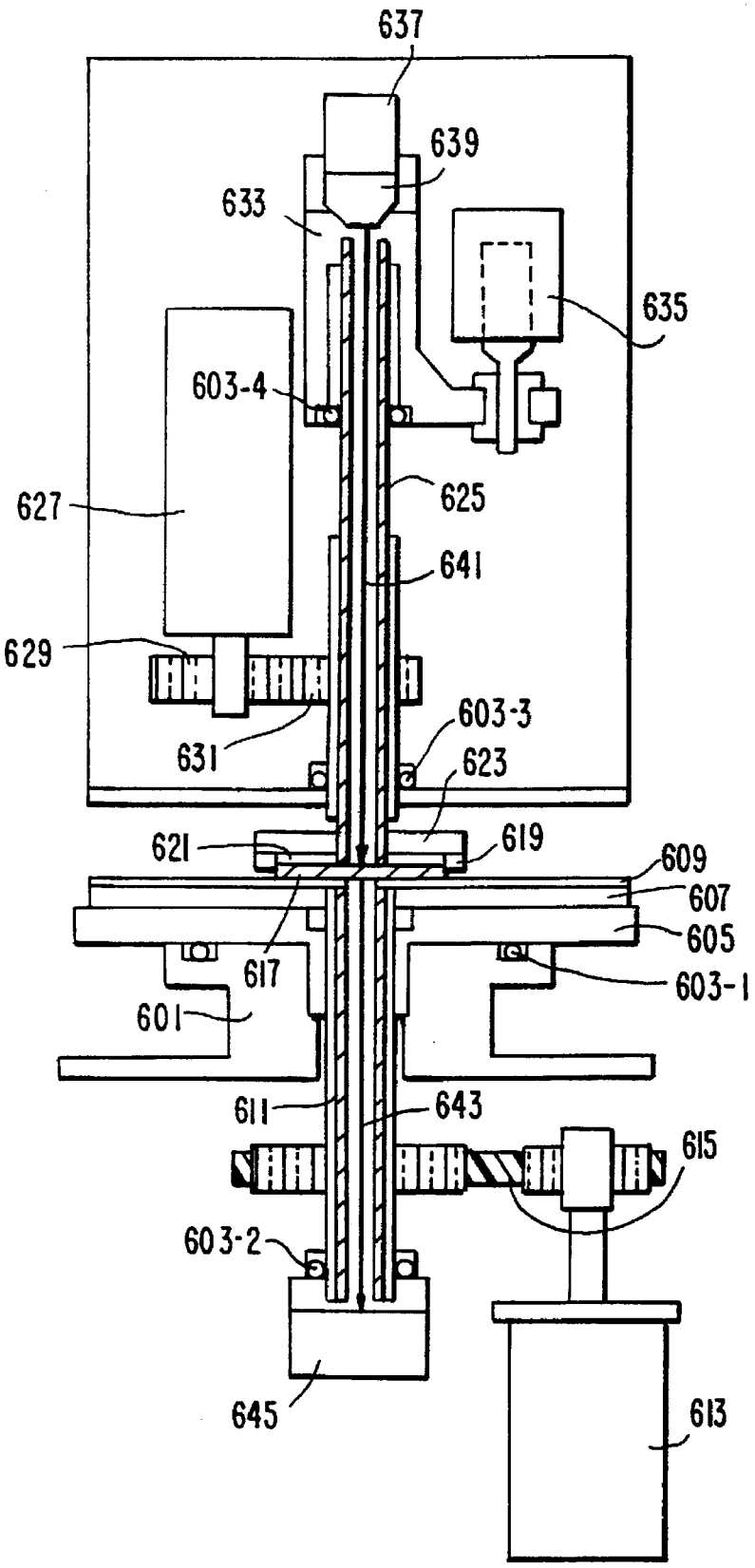
FIG. 6 is a front elevational view of a polishing apparatus according to a first embodiment of the present invention.

Referring to FIG. 6, a polishing apparatus according to a first embodiment of the present invention will be described below.

A polishing plate support 605 is mounted on a stage 601 via a bearing 603-1. A polishing plate 607 is placed on the polishing plate support 605. A polishing cloth 609 is adhered to the polishing plate 607. To rotate the polishing plate support 605 and the polishing plate 607, a hollow drive shaft 611 is connected to central portions of those members. The drive shaft 611 is rotated by a motor 613 via a rotary belt 615.

Openings, each having a prescribed diameter, are formed in central portions of the polishing plate support 605, polishing plate 607 and polishing cloth 609 so as to expose a central portion of a wafer 617. The diameter of the openings may be smaller than 5 mm. It is preferred that the diameter of the openings be larger than the diameter of transmitted light (described later) but small enough not to influence the polishing of a central portion of the wafer 617.

The wafer 617 is suctioned, by vacuum or stretching, by a suction plate 623 on which a template 619 and a suction cloth 621 are provided so as to be opposite and facing the polishing cloth 609.

Openings, each having a prescribed diameter, are formed in central portions of the suction plate 623 and the suction cloth 621 so as to expose a central portion of the wafer 617. The diameter of the openings may be smaller than 5 mm. It is preferred that the diameter of the openings be larger than the diameter of an infrared light beam (described later) but small enough not to influence the polishing of a central portion of the wafer 617.

The suction plate 623 is connected to a hollow drive shaft 625, which is rotated by a motor 627 via a gear 629 and a gear 631 that is on the drive shaft 625. The drive shaft 625 is fixed to a driving stage 633 with respect to vertical movement. With this structure, the driving stage 633 may be moved vertically with vertical movement of a cylinder 635 and, as a result, the wafer 617 that is fixed to the suction plate 623 can be pressed against the polishing cloth 609 or removed therefrom. The apparatus has a separate driving system (not shown) to move the wafer 617 in the X/Y directions during a polishing operation.

An infrared light source 637 that can emit light having a wavelength range of 2.5 μm to 25 μm and a spectroscope 639 for dispersing the infrared light emitted from the light source 637 are mounted at a top portion of the driving stage 633. Infrared light 641 emanating from the spectroscope 639 goes through the inside of the drive shaft 625, passes through the openings (larger than the diameter of the infrared light beam 641) of the suction plate 623 and the suction cloth 621, and reaches the wafer 617.

Transmission light 643 of the infrared light 641 transmitted from the wafer 617 passes through the openings (larger than the diameter of the transmission light beam 643) of the polishing cloth 609, polishing plate 607 and polishing plate support 605, goes through the inside of the hollow drive shaft 611, and is detected by a photodetector 645 attached to the end of the drive shaft 611.

With the above configuration, the polishing end point can be detected with high accuracy.

Since the wafer performs a complex movement that is a combination of a movement in the X/Y directions and a rotation of the suction plate 623 caused by the drive shaft 625, the infrared light 641 is interrupted approximately at regular intervals. A setting may be made so that the period of the above complex movement is automatically shortened as the polishing approaches its end point.

Alternatively, the span and the speed of the X/Y movement and the rotational speed of the suction plate 623 may be controlled when necessary or by presetting using a control means (not shown) so that the period is automatically shortened in a proper manner while the polishing state is monitored.

As a result, the number of times per unit time the transmission light 643 is detected by the photodetector 645 can be increased when the polishing approaches its end, compared to the number at the start of polishing. This can prevent excessive polishing as would otherwise be caused by a failure of detecting the polishing end point due to interruption of the infrared light 641.

The photodetector 645 is mounted so as not to rotate together with the drive shaft 611, and is fixed to the drive shaft 611 via a bearing 603-2.

When the infrared light 641 passes through the wafer 617, energy absorption occurs at a certain wavelength, which is specific to the types of atoms and coupling atoms. Therefore, the polishing end point can be detected by monitoring the amount of energy absorption at a wavelength that is specific to a film being polished.

Figure 7:
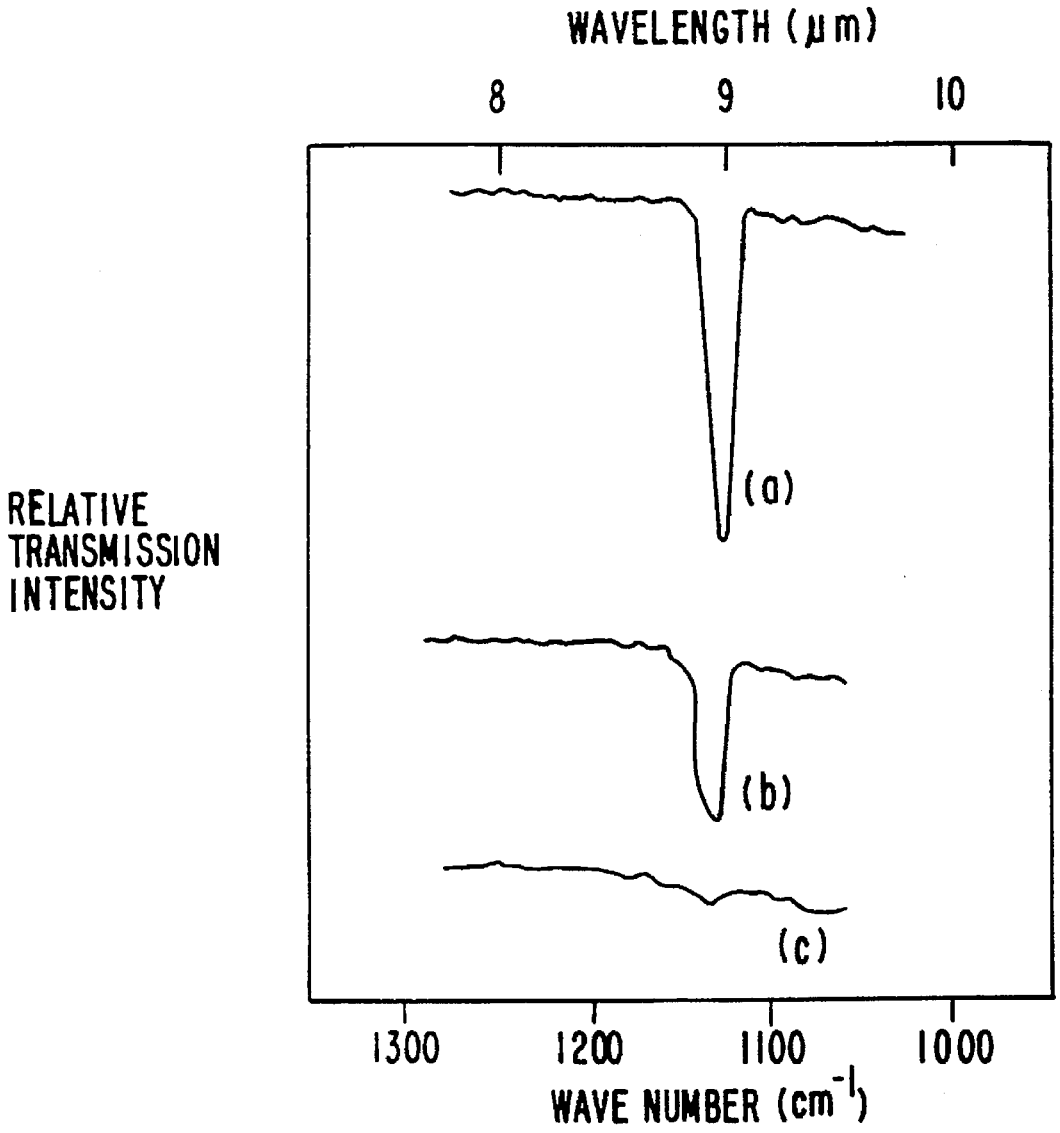
FIG. 7 shows waveforms of infrared absorption spectra of $SiO_2$.

The CMP method of FIGS. 3(*a*)–3(*d*) is taken as an example. In the state of FIG. 3(*c*), the $SiO_2$ film 304 is formed on the entire surface. Therefore, as shown by curve (a) in FIG. 7, a peak having a large relative transmission intensity due to infrared energy absorption specific to $SiO_2$ is detected between 9.0 and 9.4 μm. As the polishing of the $SiO_2$ film 304 proceeds and the $SiO_2$ film 304 becomes thinner, the relative transmission intensity of the peak due to the $SiO_2$ infrared absorption becomes smaller, as shown by curve (b) in FIG. 7. After the $SiO_2$ film 304 is completely polished as shown in FIG. 3(*d*), only a very small peak that corresponds to the amount of $SiO_2$ buried in the grooves 303 of the Si substrate 301 is detected as shown by curve (c) in FIG. 7.

Figure 8:
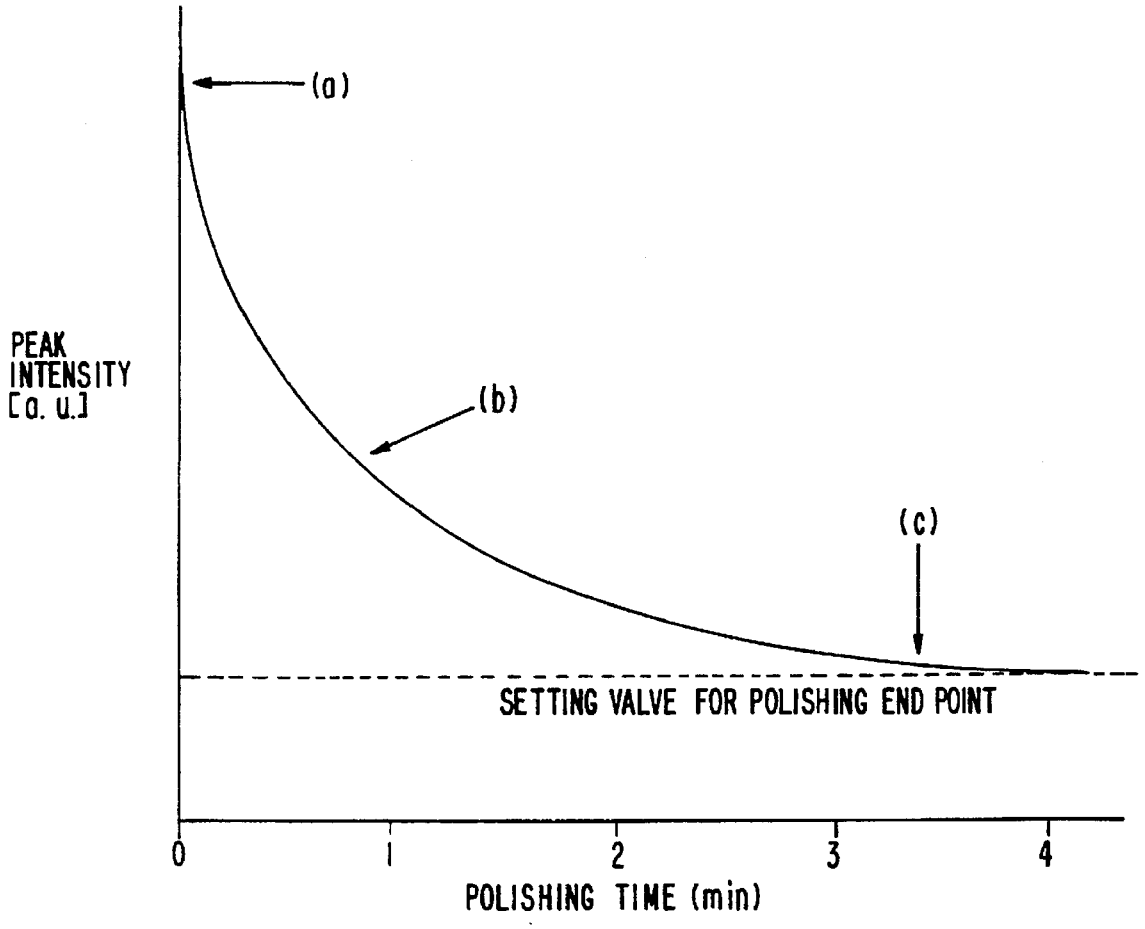
FIG. 8 is a graph showing the relationship between the peak intensity of the infrared absorption spectrum of $SiO_2$ and the polishing time.

FIG. 8 is a graph obtained by monitoring the relationship between the peak intensity of the infrared absorption due to $SiO_2$ and the polishing time. Peak intensities indicated by (a)–(c) in FIG. 8 correspond to the peaks of curves (a)–(c) in FIG. 7, respectively. As seen from FIG. 8, the end point can be detected automatically by properly setting, in advance, a peak intensity value of the $SiO_2$ infrared absorption signal which value corresponds to the polishing end point. This makes it possible to leave a polishing film of a certain thickness, or remove it.

Further, it becomes possible to change the polishing film in a desired manner by changing the monitoring wavelength range. For example, when the polishing film is a $Si_3N_4$ film, the end point can be detected in the same manner as in the case of a $SiO_2$ film by setting the monitoring wavelength range to 11.4–12.5 μm.

Figure 9:
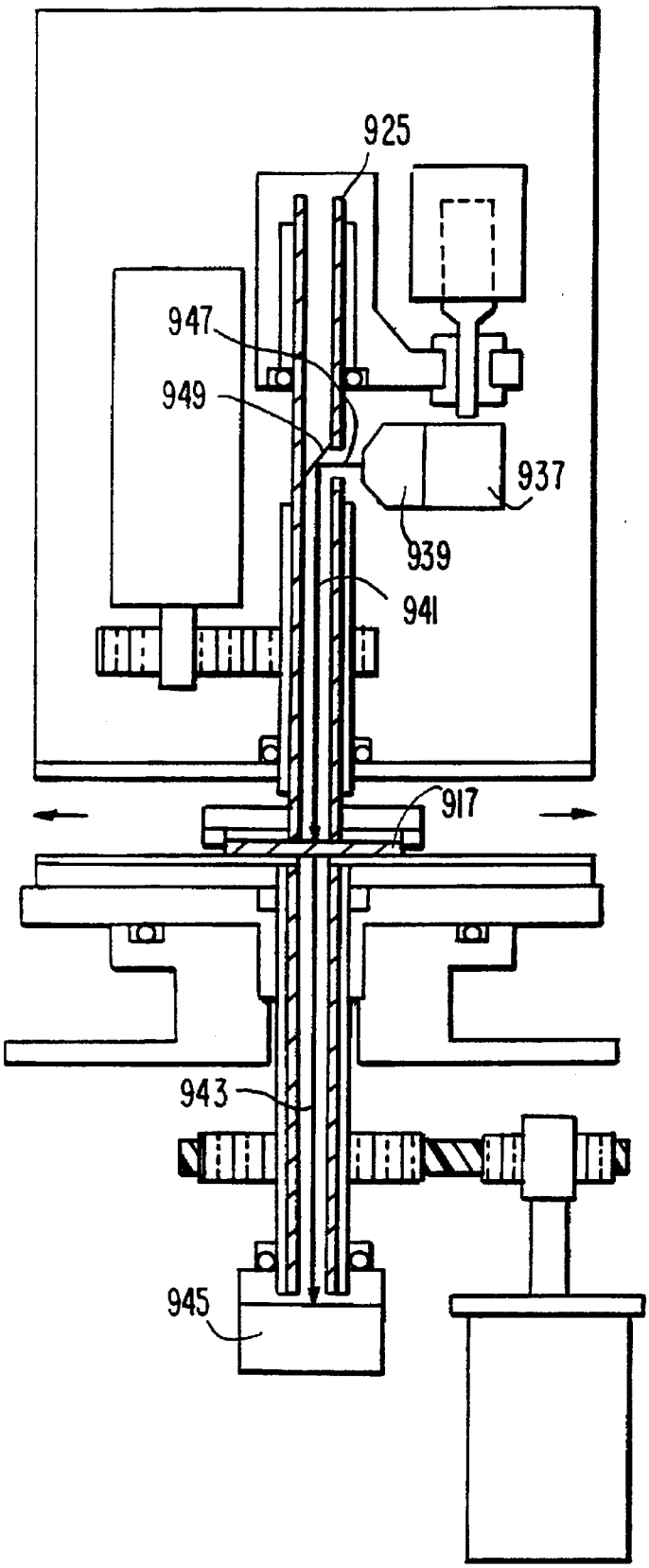
FIG. 9 is a front elevational view of a polishing apparatus according to a second embodiment of the present invention.

FIG. 9 shows a polishing apparatus according to a second embodiment of the present invention, which is characterized in the setting position of the infrared light source. The configuration, other than the parts described below, is the same as that in the apparatus of FIG. 6, and a description thereof is omitted.

A hole 947 that allows passage of infrared light 941 is formed in a drive shaft 925 at a prescribed position (for instance, at a midpoint). A minor 949 is provided in the vicinity of the hole 947 in the hollow drive shaft 925.

The infrared light 941 emitted from an infrared light source 937 and then horizontally emanating from a spectroscope 939 passes through the hole 947 and then reflected by the mirror 949. The reflected infrared light 941 goes through the inside of the drive shaft 925, and strikes a wafer 917 vertically. Then, transmission light 943 from the wafer 917 is detected by a photodetector 945.

There occurs no problem even if a plurality of holes are formed in the drive shaft 925. In this case, the mounting position and the shape of the mirror have to be contrived so that the infrared light 941 strikes the wafer 917.

This embodiment can provide the same advantages as the first embodiment. In addition, the infrared light source 937 can be set at various positions along the longitudinal direction of the drive shaft 925, which means an increased degree of freedom of the setting position.

Figure 10:
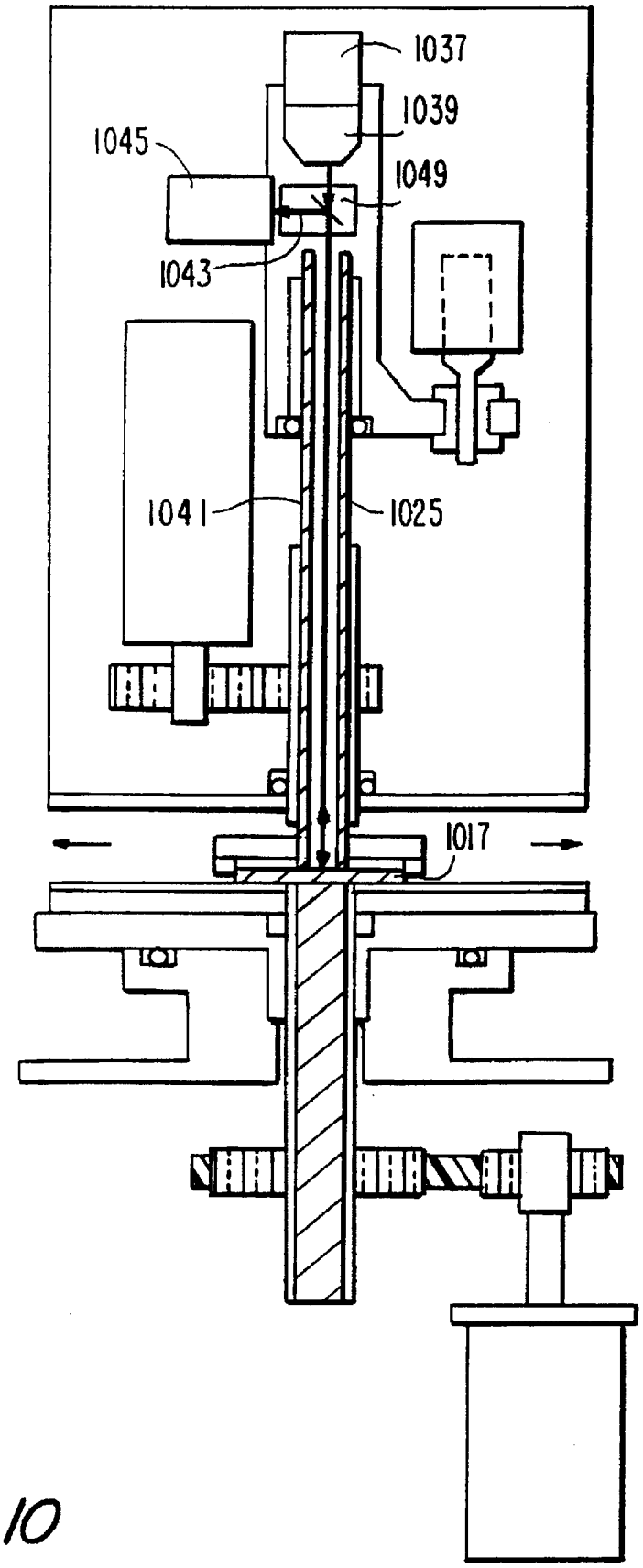
FIG. 10 is a front elevational view of a polishing apparatus according to a third embodiment of the present invention.

FIG. 10 shows a polishing apparatus according to a third embodiment of the present invention, which is characterized in the setting position of the photodetector. The configuration, other than the parts described below, is the same as that in the apparatus of FIG. 6, and a description thereof is omitted.

Infrared light 1041 emitted from an infrared light source 1037 and then emanating from a spectroscope 1039 passes through a half mirror 1049, goes through the inside of a drive shaft 1025, and strikes a wafer 1017.

The infrared light 1041 made incident on the back face of the wafer 1017 goes through the wafer 1017, is vertically reflected by the front face (the face being polished) of the wafer 1017, again goes through the wafer 1017 and the inside of the drive shaft 1025, and returns to the half mirror 1049. The infrared light returned from the wafer 1017 is reflected by the half mirror 1049 in a prescribed direction, and detected by a photodetector 1045.

This embodiment enables accurate detection of the polishing end point.

Figure 11:
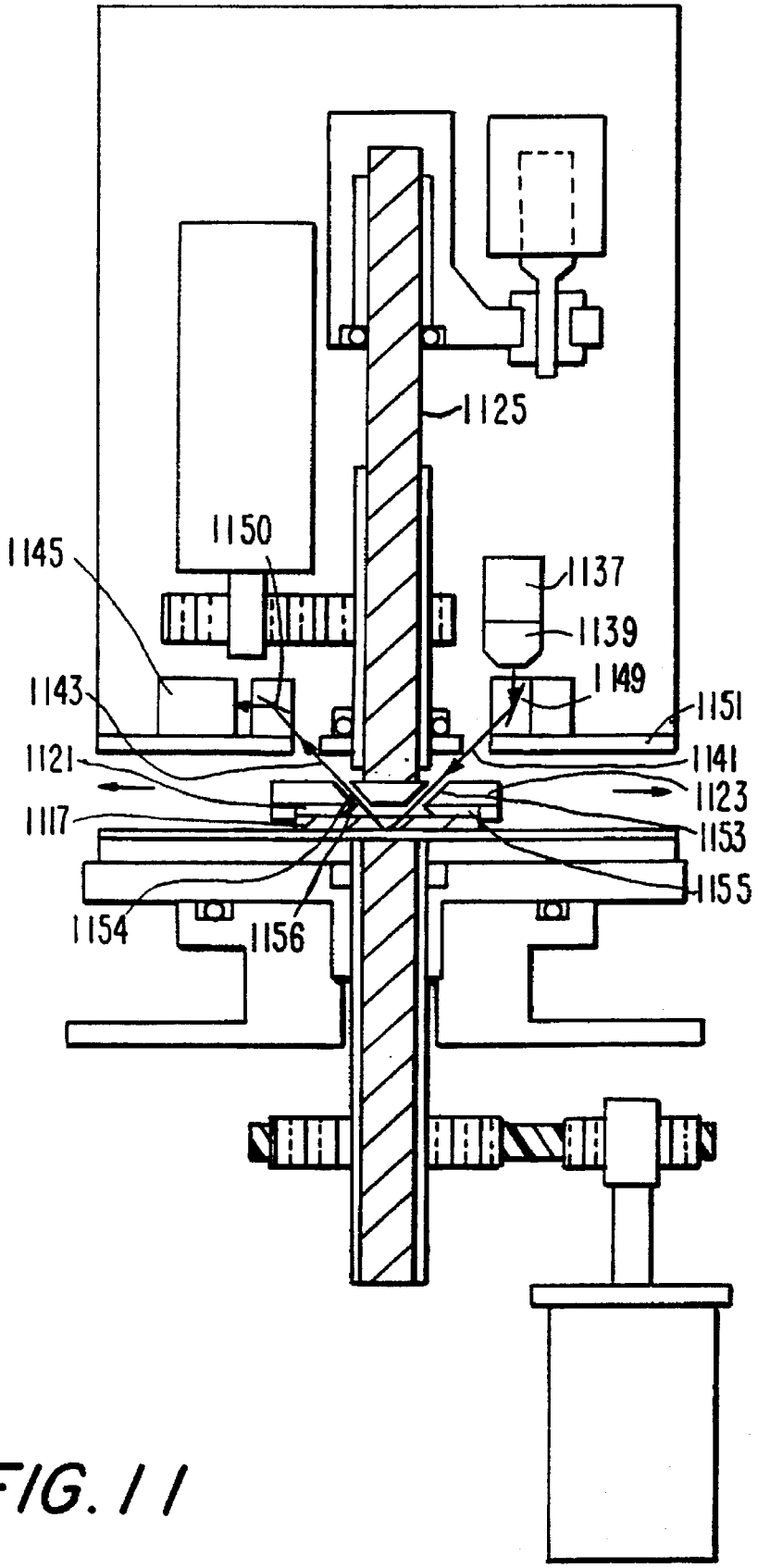
FIG. 11 is a front elevational view of a polishing apparatus according to a fourth embodiment of the present invention.

FIG. 11 shows a polishing apparatus according to a fourth embodiment of the present invention, which is characterized in the setting positions of the infrared light source and photodetector and the structures of the suction plate and suction cloth. The configuration, other than the parts described below, is the same as that in the apparatus of FIG. 6, and a description thereof is omitted.

An infrared light source 1137 is disposed beside a drive shaft 1125. A mirror 1149 is so disposed as to direct infrared light 1141, which is emitted from the infrared light source 1137 and then emanates from a spectroscope 1139, toward a wafer 1117. A suction plate 1123, which is connected to the drive shaft 1125, is provided with through-holes 1153 and 1154 that together assume a V shape. Therefore, the infrared light 1141 strikes the wafer 1117 and the infrared light 1143 reflected from the wafer 1117 enters a photodetector 1145 after being reflected by a mirror 1150. A suction cloth 1121 is also formed with holes 1155 and 1156 for passing the infrared light beams 1141 and 1143 at positions corresponding to the through-holes 1153 and 1154 of the suction plate 1123.

The infrared light 1141 passes through the through-hole 1153 and the hole 1155, and strikes the wafer 1117. The incident infrared light 1141 is then reflected by the front face of the wafer 1117. The resulting infrared light 1143 passes through the hole 1156 and the through-hole 1154, reflected by the mirror 1150, and detected by the photodetector 1145.

Since the drive shaft 1125 rotates, the infrared light 1141 is interrupted at regular intervals. That is, the infrared light 1141 reaches the wafer 1117 after alternately passing through the through-holes 1153 and 1154 every half rotation of the drive shaft 1125, i.e., the suction plate 1123. To shorten the interruption intervals of the infrared light 1141 and detect the infrared light 1143 more frequently, more through-holes and holes may be provided.

This embodiment enables accurate detection of the polishing end point.

Figure 12:
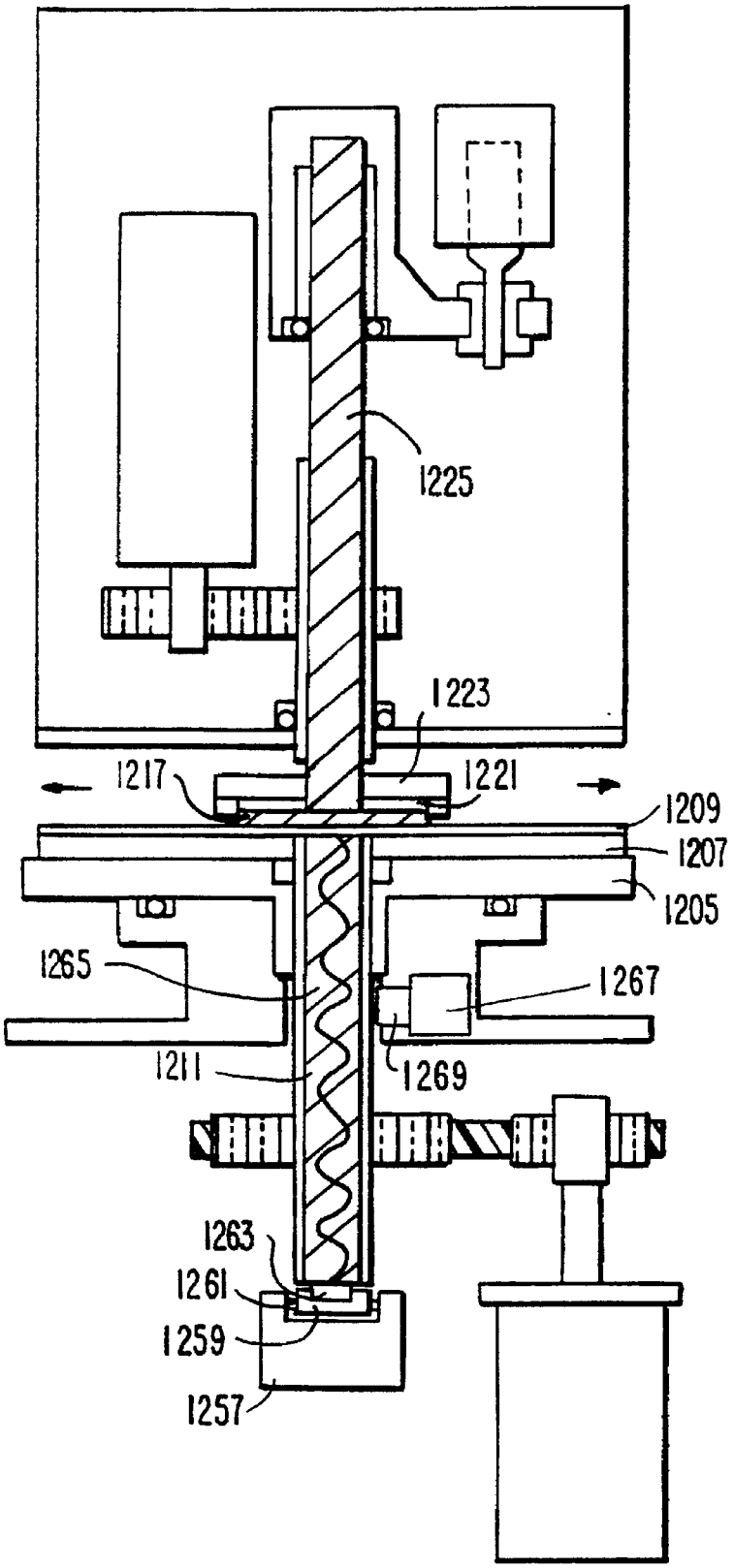
FIG. 12 is a front elevational view of a polishing apparatus according to a fifth embodiment of the present invention.

FIG. 12 shows a general configuration of a polishing apparatus according to a fifth embodiment of the present invention in which the polishing end point is detected from a variation of the strength of vibration applied to the drive shaft. The configuration, other than the parts described below, is the same as that in the apparatus of FIG. 6, and a description thereof is omitted.

A vibrator 1263 for generating vibration and a vibrator support 1259 are fixed to the bottom end of a drive shaft 1211, and mounted so as to rotate together with the drive shaft 1211. A voltage from a power supply 1257 (which does not rotate) is applied to the vibrator 1263 via a brush 1261. Vibration generated by the vibrator 1263 is propagated along the drive shaft 1211 as a vibration wave 1265, and reaches a wafer 1217.

As the polishing of a polishing film formed on the front face of the wafer 1217 proceeds and a stopper film starts to be exposed, a friction coefficient between the front face of the wafer 1217 and a polishing cloth 1209 in contact therewith varies quickly, which causes an abrupt variation of the strength of the vibration wave 1265.

A displacement sensor 1269 and a displacement sensor support 1267 are disposed beside the drive shaft 1211. The displacement sensor 1269 detects a variation of the strength of the vibration wave as a variation in electric field strength or magnetic field strength of a very small gap between the drive shaft 1211 and the displacement sensor 1269, and converts the detected variation to an electrical signal. If a variation of the strength of the vibration wave 1265 applied to the drive shaft 1211 is monitored by the displacement sensor 1269, an electrical signal amplitude obtained when a stopper film is exposed is much larger than that obtained while a polishing film is being polished. The polishing end point can be detected by performing monitoring so as to detect the above variation.

It is desired that the frequency of the vibrator 1263 be lower than 100 MHz. Further, the power of the vibrator 1263 may be set so as not to adversely affect the rotation of the drive shaft 1211 and the wafer polishing accuracy.

In any of the embodiments described above, the polishing end point can be detected while a wafer being polished is rotated, or without causing a wafer to perform any extra movement other than the polishing movement. Therefore, the embodiments of the present invention do not require a longer polishing time than for conventional polishing methods.

What is claimed is:

1. A polishing apparatus comprising:

a polishing plate having a polishing cloth;

first driving means having a first drive shaft for rotating said polishing plate;

a suction plate having a suction cloth for fixing of a semiconductor wafer on which a polishing film and a stopper film are formed, said suction plate and said suction cloth having respective openings of prescribed diameters substantially at their central portions;

second driving means having a second drive shaft adapted to rotate said suction plate and said wafer for polishing said wafer, said second drive shaft being hollow;

infrared light supplying means for supplying infrared light to said semiconductor wafer; and means for detecting a polishing end point of said polishing film by detecting a variation of the intensity of said infrared light supplied to said semiconductor wafer.

2. The polishing apparatus according to claim 1 further, comprising a half mirror provided at an end portion of said second drive shaft on an end opposite to said semiconductor wafer, for transmitting said infrared light coming from said infrared light supply means and reflecting the infrared light returning from said semiconductor wafer toward said detecting means.

3. The polishing apparatus according to claim 1, further comprising a mirror arranged in said second drive shaft, and wherein a side wall of said second drive shaft is formed with an opening at a position opposite said mirror so that said infrared light passes through said opening to strike said mirror.

4. A polishing apparatus comprising:

a polishing plate having a polishing cloth, said polishing plate and said polishing cloth having respective openings of prescribed diameters substantially at their central portions;

first driving means having a first drive shaft for rotating said polishing plate, said first drive shaft being hollow;

a suction plate having a suction cloth for fixing of a semiconductor wafer on which a polishing film and a stopper film are formed, said suction plate and said suction cloth having respective openings of prescribed diameters substantially at their central portions;

second driving means having a second drive shaft for rotating said suction plate, said second drive shaft being hollow;

infrared light supplying means for supplying infrared light to said semiconductor wafer; and means for detecting a polishing end point of said polishing film by detecting a variation of the intensity of said infrared light supplied to said semiconductor wafer.

5. A polishing apparatus comprising:

a polishing plate having a polishing cloth;

first driving means having a first drive shaft for rotating said polishing plate;

a suction plate having a suction cloth for fixing of a semiconductor wafer on which a polishing film and a stopper film are formed, said suction plate having at least a pair of through-holes arranged at an angle to said semiconductor wafer, the suction cloth having at least a pair of holes that are located at positions corresponding to said pair of through-holes;

second driving means having a second drive shaft for rotating said suction plate;

infrared light supplying means for supplying infrared light to said semiconductor wafer; and means for detecting a polishing end point of said polishing film by detecting a variation of the intensity of said infrared light supplied to said semiconductor wafer.

6. The polishing apparatus according to claim 1, wherein the diameter of the opening of said suction cloth is less than 5 mm.

7. The polishing apparatus according to claim, 4, wherein the diameter of the opening of said polishing cloth is smaller than 5 mm.

8. The polishing apparatus of claim 4, wherein the diameter of the opening of said suction cloth is less than 5 mm.

9. The polishing apparatus of claim 5, wherein the diameter of the opening of said suction cloth is less than 5 mm.

* * * * *